US005405304A

United States Patent [19]

Petersheim et al.

[11] Patent Number: 5,405,304

[45] Date of Patent: Apr. 11, 1995

[54] MULTIPLE PATHWAY PLAY APPARATUS FOR CLIMBING AND CRAWLING

[75] Inventors: Richard J. Petersheim; James F. Gleeson, both of Charlotte, N.C.

[73] Assignee: Discovery Zone, Inc., Chicago, Ill.

[21] Appl. No.: 845,119

[22] Filed: Mar. 3, 1992

[51] Int. Cl.[6] ..... A63B 9/00

[52] U.S. Cl. ..... 482/35; 482/78; 434/258

[58] Field of Search ..... 482/35, 48, 78, 36, 482/37; 119/29; 446/901; 472/16, 30; 273/26 A; 434/258

[56] References Cited

U.S. PATENT DOCUMENTS

| | | | |
|---|---|---|---|
| 2,883,192 | 4/1959 | Royston | 482/35 |
| 3,132,432 | 5/1964 | Yee | 273/26 A |
| 3,814,416 | 6/1974 | Munger et al. | 272/56.5 |
| 3,970,301 | 7/1976 | Lehmann | 482/35 |
| 5,116,056 | 5/1992 | Schmutte | 273/26 A |
| 5,167,595 | 12/1992 | Gleeson et al. | 482/35 |

*Primary Examiner*—Stephen R. Crow
*Attorney, Agent, or Firm*—Jenner & Block

[57] ABSTRACT

A play apparatus is disclosed for climbing and crawling that is especially suitable for indoor play grounds. In one embodiment, the play apparatus includes a frame having a plurality of spaced apart netting supports extending across the width of the frame. The netting supports are located at least two different heights, and netting spans the netting supports to define at least one climbing and crawling pathway thereover.

20 Claims, 2 Drawing Sheets

MULTIPLE PATHWAY PLAY APPARATUS FOR CLIMBING AND CRAWLING

FIELD OF THE INVENTION

The invention relates to play apparatus in general, and children's climbers in particular.

BACKGROUND OF THE INVENTION

While children's play apparatus has been around for decades, many parents are unaware of the fundamental role playing has in a child's physical, mental and social development. Generally, play apparatus, such as well-known playground slides and monkey bars, does not offer the fullest opportunity for children to develop. Moreover, some prior art provided limited protection in the event of a fall. In particular, there is a need for play apparatus that allows children to practice climbing and balance skills, while safely taking risks. Specifically, there is a need for play apparatus that minimizes risk of injury to children playing thereon.

SUMMARY OF THE INVENTION

In accordance with the invention, play apparatus is disclosed which provides children, and particularly small children, with safe, challenging play by which the children can develop their imaginations, self-confidence, physical strength, agility, and social skills. In accordance with the invention, passive safety structures are also incorporated into the design of the play apparatus.

In a preferred embodiment of the invention, several spaced-apart netting supports are secured to a frame which defines an outer boundary of the play apparatus. The netting supports are located at different heights, and extend across the width of the frame. The netting, preferably a cotton cargo net having a fine mesh backing, is strung between the netting supports and defines a pathway over which children climb and crawl.

In some cases, the netting supports include two upper supports and two lower supports. From a horizontal perspective, the upper supports are located between the lower supports. The netting extends from one of the lower supports, over the two upper supports and then is secured to the other lower support. In this manner, the netting provides a climbing and crawling pathway over the two upper and two lower supports.

In other cases, a third lower netting support is provided between the other two lower supports. A generally vertical netting extends downward from the third lower support, so that the netting and the third support define a second climbing and crawling pathway over the third support and under the upper two supports.

The frame is constructed from individual frame members, which may be straight hollow pipes or bars. The bars may be of metal, and may be conventionally clamped together. Preferably, the bars are covered with a jacket of foam padding with a vinyl sleeve thereover. The vinyl sleeve may have a grommet-bearing flange attached to it for mounting netting to the bar. This netting may be stung between frame members to partially enclose the interior region of the play apparatus.

The netting supports are also, made of straight, hollow members such as pipes or bars, which are conventionally clamped to frame members. The netting support bars are also covered with a jacket of foam padding and a vinyl sleeve. Netting is secured to a particular netting support by wrapping netting around the support and lacing together portions of the netting.

To prevent netting from slipping around netting supports, each netting support is equipped with an elongated strap which is inserted through the hollow longitudinal extent of the netting supports. Opposing ends of the strap extend from each end of the netting support, and are secured to adjacent portions of netting. The length of the strap is only slightly longer than the length of its respective netting support, such that each of the portions of netting engaged by a strap end is held securely in place near its adjacent end of the netting support. Because the pathways are defined by netting, children on one pathway can see into the next. This visual connection between pathways sharpens children's sense of spatial awareness as well as promotes social interaction among children on different pathways.

DETAILED DESCRIPTION OF THE INVENTION

In accordance with the present invention, a play apparatus for climbing and crawling that is especially suitable for indoor playgrounds and use is provided. In the illustrated preferred embodiment hereinafter described, the play apparatus includes multiple climbing and crawling pathways so that the child utilizing the apparatus can choose which path to traverse. The apparatus also helps develop hand-eye coordination because of its tactile qualities, and the construction reassures and builds children's confidence in crawling and climbing over surfaces that are elevated from ground level, while minimizing risk of injury to the child utilizing the apparatus.

Figure 8:
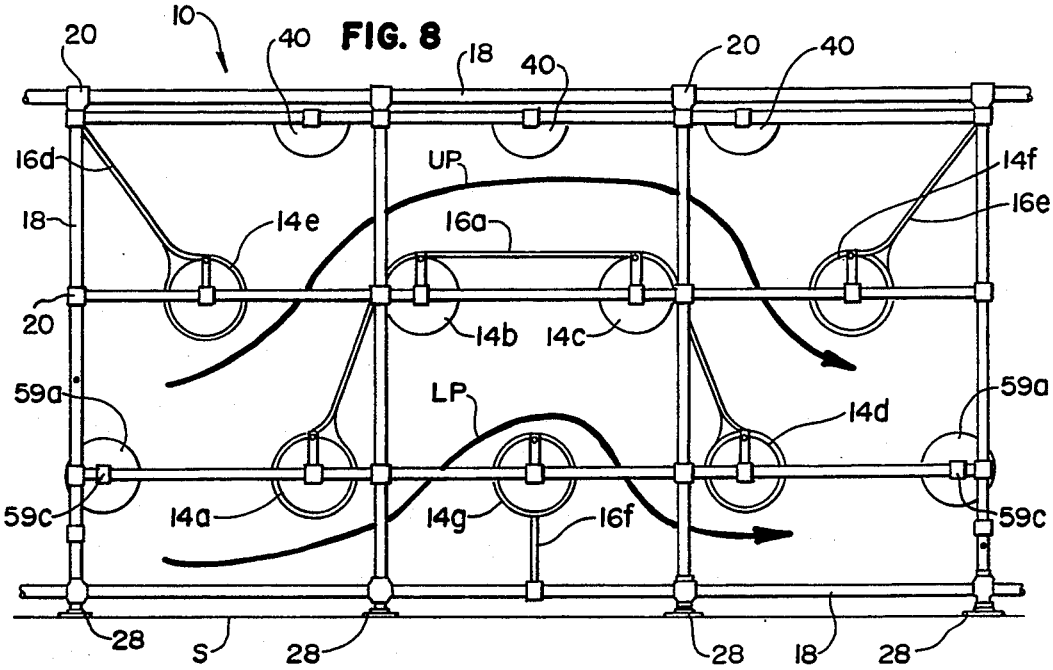
FIG. 8 is a side view of the play apparatus shown in FIG. 1.

Referring to the Figures generally, and in particular to FIGS. 1–4 and 8, there is illustrated a climbing and crawling play apparatus 10 in accordance with the invention. Climbing and crawling play apparatus 10 is composed of a frame 12, a plurality of netting support members 14 extending transversely of the climbing and crawling pathways indicated by arrows UP and LP and netting 16 (as best seen in FIG. 8). For clarity, it should be noted that not every netting support 14 illustrated in FIGS. 1–4 is indicated by a reference number. Also, netting supports 14 are designated individually as netting supports 14*a*, 14*b*, etc. and netting 16 is designated individually as 16*a*, 16*b*, etc. Netting 16 is suspended from netting support members 14 and defines part of the climbing and crawling pathways of play apparatus 10.

As illustrated in FIG. 8, frame 12 can be conveniently constructed of sections of straight pipe 18 connected with conventional clamps or sleeve connectors 20 to form frame 12 that defines the outer boundaries of play apparatus 10. Since frame 12 is constructed of straight pipe 18 and connection 20, construction of frame 12 is relatively simple and straightforward. For clarity, it should be noted that not every pipe 18 or sleeve connector 20 illustrated in the figures is indicated by a reference numeral.

Figure 6:
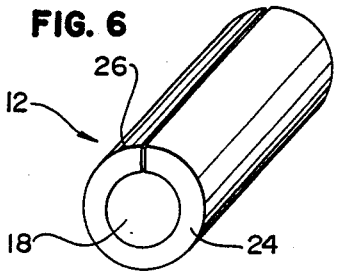
FIG. 6 is an enlarged perspective view of a section of the frame that is part of the play apparatus shown in FIG. 1.

Preferably, pipe sections 18 of frame 12 are each covered with suitable padding to reduce the risk of injury should a child bump or otherwise come into contact with frame 12, further described with respect to FIG. 6.

Referring to FIG. 6, padding of frame 12 is a layer of resilient foam material 24 that surrounds straight pipe sections 18 and sleeve connectors 20. Resilient foam material may be applied to frame 12 as a sleeve having a longitudinal slit extending through the sidewall thereof. Typically, for straight pipe that has a two-inch outer diameter, a resilient foam material sleeve form will be utilized having an inner diameter of two inches and a wall thickness of approximately 1.5 inches.

Preferably, for durability and aesthetic appearance, resilient foam material 24 is covered with vinyl 26 or other suitable covering material. Vinyl 26 surrounds resilient foam material 24 and is attached by any suitable method such as forming the vinyl into a snugly fitting jacket.

To increase the stability of play apparatus 10, feet 28 may be provided for engagement with the ends of straight pipes 18 located at the bottom of play apparatus 10. Feet 28 also prevent damage to the floor or other surface on which play apparatus 10 rests.

Netting support members 14 in the illustrated embodiment are cylindrical and extend from one sidle of frame 12 to the other, extending transversely of the climbing and crawling path of apparatus 10.

Figure 10:
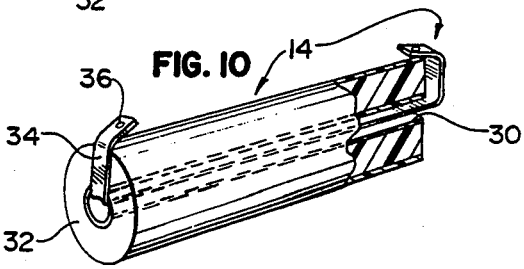
FIG. 10 is a cut-away perspective view of the netting support member shown in FIG. 9.

The construction of netting support members 14 is illustrated in FIG. 10. As illustrated,, support members 14 include a center straight pipe section 30, a sleeve of resilient foam material 32 concentric with center straight pipe section 30 and a suitable covering over concentric foam 32, such as vinyl or other suitable, durable material. The foam covering may be in the form of a sleeve that is slitted through the sleeve wall to facilitate covering of straight pipe section 30.

Netting support members 14 are attached to frame 12 at desired spaced apart locations to define the desired climbing and crawling pathways in conjunction with netting 16 as hereinafter described.

Netting 16 generally should be of a diameter and grid size to facilitate climbing and crawling thereover. Preferably, netting 16 is a high strength netting having strands of 0.5 inches in cross-sectional diameter, such as used in cargo nets. Netting 16 is made of cotton, which has appealing tactile qualities. Netting 16 may also be made of nylon or other materials. Netting 16 is illustrated as a square five-inch grid. Netting 16 may include an adjacent mesh layer of finely perforated material (not shown). In this double layer construction, the netting 16 provides structural strength, while the mesh layer prevents small arms and legs from slipping through the interstices of the strands forming net 16.

Netting 16 is attached to netting support members 14 to partition play apparatus 10 into the desired climbing and crawling pathways. As illustrated in FIG. 8, multiple pathways are provided for climbing and crawling, in this case, an upper pathway indicated by arrow UP and a lower pathway indicated by arrow LP in FIG. 8. Netting 16 extends from netting support: members 14*a*, 14*b*, 14*c* and 14*d* to define the surface over which lapper pathway UP traverses through play apparatus 10. Netting support members 14*e* and 14*f* are located in upper corners of frame 12 and narrow the entrance and exit of upper pathway UP in conjunction with netting 16*d* and 16*e* extending from netting support members 14*e* and 14*f*, respectively, and extending to the nearest corner of frame 12, as illustrated in FIG. 8.

Lower pathway LP is defined by the surface S upon which play apparatus 10 is supported and by netting support member 14*g* and netting 16*f*. The top of lower pathway LP is defined by netting support members 14*a*–14*d* and netting 16*a* associated with those netting support members. Netting support member 14*g* has netting 16*f* attached thereto that extends vertically downwardly from netting support member 14*g* and is attached to the bottom of frame 12 thereby causing lower pathway LP to traverse over netting support member 14*g*.

Figure 9:
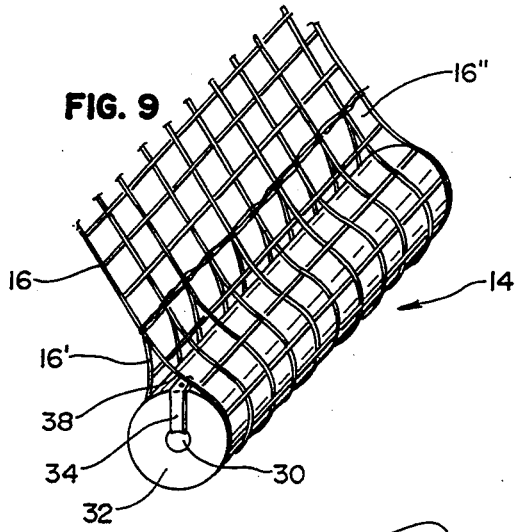
FIG. 9 is an enlarged perspective view of the netting support member that is part of the play apparatus shown in FIG. 1 connected to netting.

Netting 16 is secured to netting support members 14 as illustrated in FIGS. 9 and 10. As illustrated in FIG. 9, an end portion 16' of netting is wrapped around netting support member 14 and then stitched or laced to another portion 16" of netting 16. Netting 16 is further secured to netting support members 14 by a web strap 34, which extends through center straight pipe section 30. Each end of web strap 34 forms a loop 36 that is secured by a grommet. A side strand 38 of netting 16 is disposed within loop 36 of web strap 34 to thereby secure netting 16 to one of netting support members 14.

Figure 7:
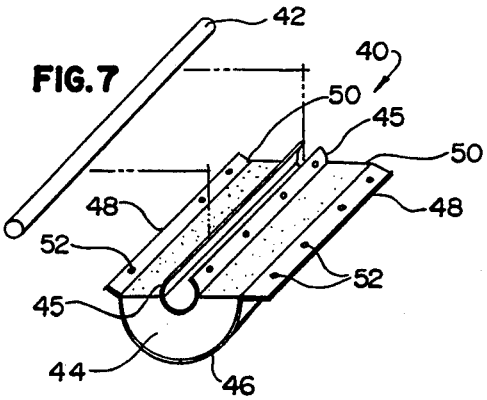
FIG. 7 is an exploded perspective view of one of the netting support members that is a part of the play apparatus shown in FIG. 1.

FIG. 7 illustrates top netting support members 40. Top netting support members 40 are located along the top of frame 12 as illustrated in FIG. 8 for securing netting 16*c* that extends along the top of play apparatus 10. For clarity, netting 16*c* is not completely illustrated in the Figures so that the components of play apparatus 10 are more easily seen. Each netting support member 40 is composed of a center straight pipe section 42 that is similar to center straight pipe section 30, previously described with respect to FIGS. 7 and 8. Netting support member 40 further includes a half cylinder foam covering material 44 concentrically located with respect to center straight pipe section 42 and suitably attached thereto by means of grommet-bearing flange 45. Half cylinder 44 protects children on upper pathway UP from bumping pipe section 42. Netting support members 40 include an outer covering 46 which can be vinyl or some other suitable material, for example. Covering 46 covers the curved portion of netting support members 40 that terminates in a flap portion 48 on either side of netting support members 40 along flat longitudinal edges 50 of concentric foam covering 44. Each of flap portions 48 includes a plurality of spaced apart apertures 52 to which netting 16*c* is secured along the top of play apparatus 10. Netting 16*c* prevents a child from climbing out the top of play apparatus 10.

Referring to FIGS. 1–5, netting 16*b* is provided along the front, rear and sides of play apparatus 10. Because netting 16b typically does not support the full weight of a child, it need not be as strong as netting 16. Along the lower portions 56 of rear and sides of play apparatus 10 are located solid covering panels 58, which can be vinyl or other suitable material. Netting 16b and solid covering panels 58 may be connected to frame in any suitable manner. For example, the edge of netting 14 may be provided with grommet-bearing flange. A line or cord can then be laced through the grommet and around one of bars 18. It will be noted that the longitudinal slits of foam material 24 accommodate the lace or cord which is eased around bars 18. Alternatively, the technique discussed in the copending U.S. patent application Ser. No. 07/845,130, filed Mar. 3, 1992 entitled "Play Apparatus Having Inclined Surfaces for Sliding or Climbing" (Attorney Docket 25570-46183) and hereby incorporated by reference, may be used.

Figure 3:
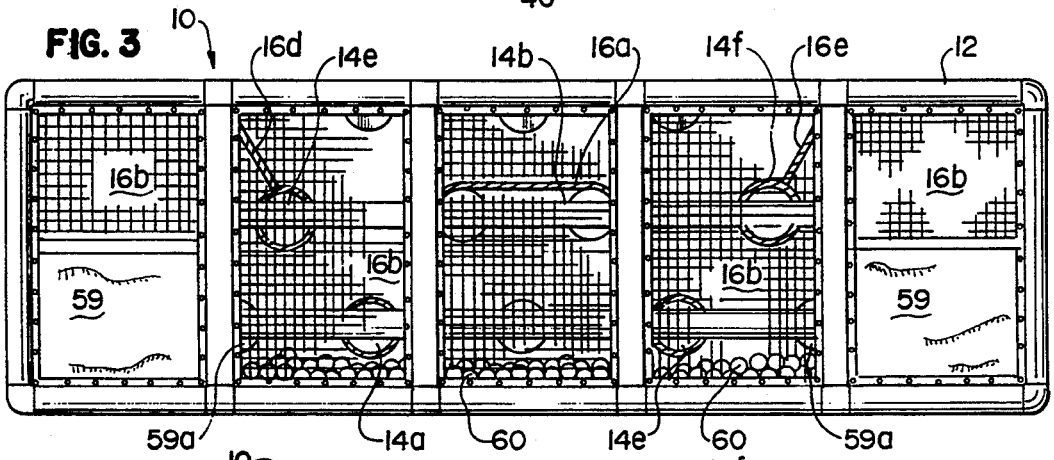
FIG. 3 is a front elevation view of the play apparatus of FIG. 1.
Figure 4:
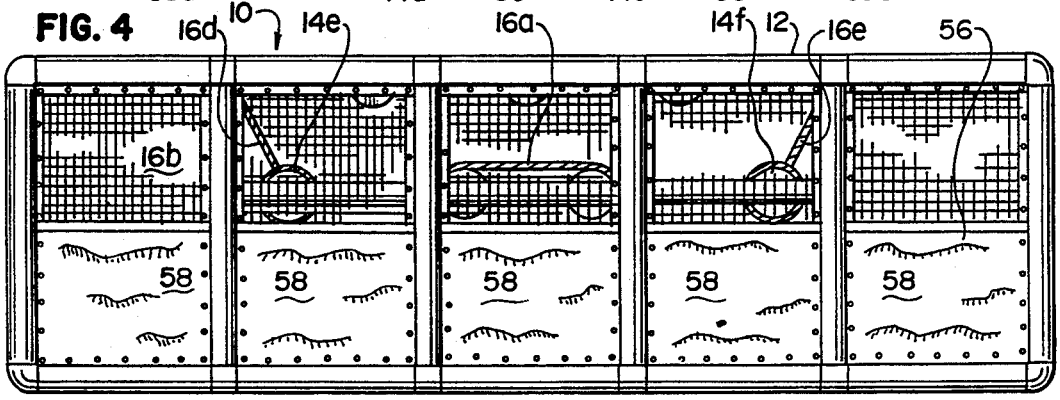
FIG. 4 is a rear elevation view of the play apparatus of FIG. 1.

Referring to FIGS. 3 and 8, netting 16b does not extend over portions 59 of the front of play apparatus 10, and the absence of netting allows portions 59 to function portals through which children may enter and exit the interior of play apparatus 10. Adjacent to portals 59 are rotatable members 59a. Rotatable members 59a are constructed in substantially the same manner as netting support 14, although rotatable members do not have web strap 34. Rotatable members 59a are suitably mounted by mounts 59b for rotation along an axis of rotation that is transverse to the direction of movement of children as they enter and exit the interior of play apparatus 10 through portal 59. A mount suitable for use as mount 59c is disclosed in the copending U.S. patent application Ser. No. 07/845,130, filed Mar. 3, 1992 entitled "Play Apparatus Having Inclined Surfaces for Sliding and Climbing" (Attorney Docket No. 25570-46205) filed concurrently herewith, the disclosure of which is hereby incorporated by reference.

Figure 1:
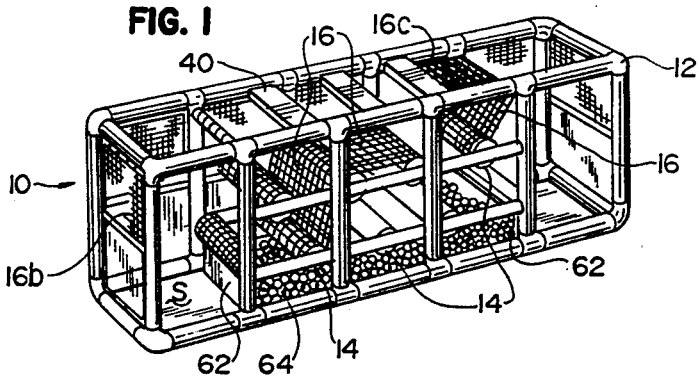
FIG. 1 is a perspective view of a play apparatus for climbing and crawling in accordance with the invention.
Figure 5:
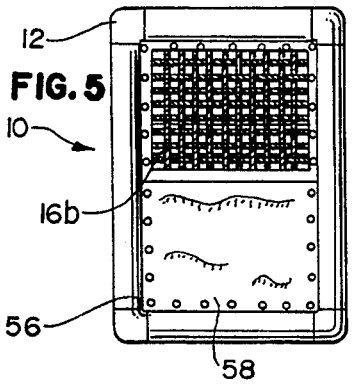
FIG. 5 is a left side elevation view of the apparatus of FIG. 1.
Figure 2:
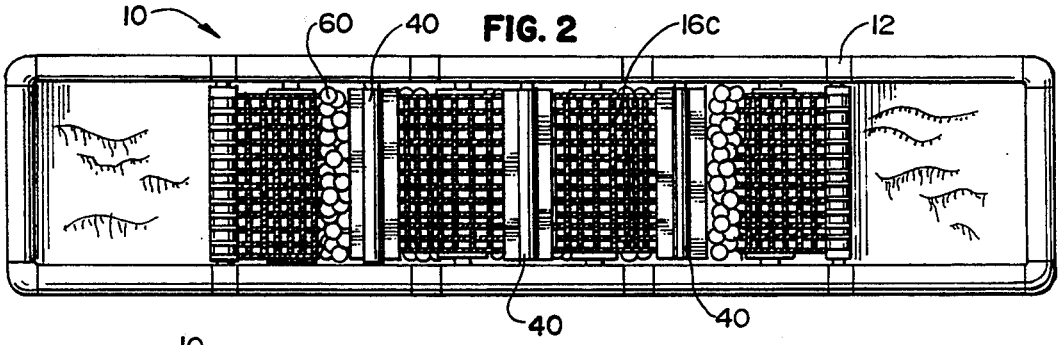
FIG. 2 is a top plan view of the play apparatus of FIG. 1.

At the bottom of play apparatus 10 may be located a plurality of balls 60. Typically, balls will be hollow soft plastic balls typically used for play pits and other similar areas. Balls 60 provide a cushion in the event that a child is climbing up or down netting 16 such as between netting support members 14a and 14b or 14c and 14d, for example. Substantially vertical partitions extend 62 extend upwardly from the bottom of play apparatus 10 to define pit areas 64 for containing balls 60, as best seen in FIGS. 1 and 3.

While the invention has been described herein with respect to certain preferred embodiments, it is to be understood that the invention is capable of numerous changes, modifications and rearrangements without department from the invention as defined in the claims.

What is claimed is:

1. A play apparatus suitable for climbing on and crawling in comprising:

a frame defining an outer boundary of the play apparatus and an elongated interior region having a length that is greater than its width and being at least partially circumscribed by said outer boundary;

a plurality of spaced apart elongated netting supports secured to the frame within said interior region and located at at least two different heights and extending across the width of said interior region, said netting supports being substantially horizontal and parallel to each other, and substantially perpendicular to the longitudinal extent of said interior region;

support netting for supporting a child, said netting being attached to the netting supports and defining at least one elongated netting climbing and crawling pathway in the apparatus, wherein the width of said netting pathway extends across the width of said interior region.

2. The apparatus of claim 1 wherein the plurality of spaced apart netting supports includes at least two laterally spaced apart upper supports and at least two laterally spaced apart lower supports, lower than the upper supports, the upper supports located horizontally between the lower supports, the netting extending from one of the lower supports, over the two upper supports and to the other of the lower supports thereby defining the climbing and crawling pathway over said supports.

3. The apparatus of claim 2 wherein the plurality of netting supports includes a third laterally spaced lower netting support and further comprising generally vertical netting extending downwardly from the third lower netting support and defining with the third lower support and the two upper supports a lower climbing and crawling pathway over the third netting support and under the two upper supports and the other two lower supports.

4. The apparatus of claim 3 further comprising two additional upper netting supports located higher than the lower supports and further comprising netting extending downwardly from said outer boundary of the play apparatus and connecting with each of said additional upper netting supports.

5. The apparatus of claim 1 further comprising a plurality of boundary nets, each net having at least one peripheral edge adapted for mounting to a grommet-bearing flange; and wherein said frame is comprised of a plurality of elongated frame members each having a flange extending along the longitudinal extent thereof, said flanges having a plurality of grommets; said frame members defining therebetween said outer boundary; and wherein each of said edges of said plurality of nets is mounted to at least one of said flanges.

6. The apparatus of claim 1 wherein at least one of said netting supports has an aperture therethrough, and further comprises securing means for securing said netting to said netting support, said securing means being elongated and having first and second longitudinal ends; said securing means being disposed in said aperture with said first and second ends extending from opposing sides of said aperture for securing engagement with said netting.

7. The apparatus of claim 1 wherein the plurality of spaced apart netting supports includes at least one laterally spaced apart upper support and at least two laterally spaced apart lower :supports, lower than the upper support, the upper support located horizontally between the lower supports, the netting extending from one of the lower supports, over the upper support and to the other of the lower supports thereby defining the climbing and crawling pathway over said supports.

8. The apparatus of claim 7 wherein the plurality of netting supports includes a third laterally spaced lower netting support and further comprising generally vertical netting extending downwardly from the third netting support and defining with the third lower support and the two upper supports a lower climbing and crawling pathway over the third netting support and under the two upper supports and the other two lower supports.

9. The apparatus of claim 8 further comprising two additional upper netting supports located higher than the lower supports and further comprising netting extending downwardly from said outer boundary of the play apparatus and connecting with each of said additional upper netting supports.

10. The apparatus of claim 1 wherein the plurality of spaced apart netting supports includes at least first, second and third supports, said first and second supports being laterally spaced apart at a first height, said third support located horizontally between said first and second support, but at a height different from said first height, wherein the netting extends from said first support around said third support and to said second support, thereby defining a climbing and crawling pathway over said supports.

11. A play apparatus suitable for climbing on and crawling in comprising:

a frame defining an outer boundary of the play apparatus and an elongated interior region at least partially circumscribed by said outer boundary, wherein said elongated interior region has a first portal located at one longitudinal end, and a second portal located at the opposite longitudinal end;

a plurality of spaced apart elongated netting supports secured to the frame within said interior region and located at at least two different heights and extending across the width of the frame said netting supports capable of supporting netting in a nonvertical orientation; and netting attached to the netting supports, said netting forming at least one nonvertical pathway over which children can climb or crawl in the apparatus, said pathway extending in a lateral direction across the entire width of said interior region, and extending in a longitudinal direction at least part way between said first and second portals, so that a child can travel from one portal to another by traversing said pathway.

12. The apparatus of claim 11 wherein the plurality of spaced apart netting supports includes at least two laterally spaced apart upper supports and at least two laterally spaced apart lower supports, lower than the upper supports, the upper supports located horizontally between the lower supports, the netting extending from one of the lower supports, over the two upper supports and to the other of the lower supports thereby defining the climbing and crawling pathway over said supports.

13. The apparatus of claim 11 wherein the plurality of netting supports includes a third laterally spaced lower netting support and further comprising generally vertical netting extending downwardly from the third lower netting support and defining with the third lower support and the two upper supports a lower climbing and crawling pathway over the third netting support and under the two upper supports and the other two lower supports.

14. The apparatus of claim 11 further comprising two additional upper netting supports located higher than the lower supports and further comprising netting extending downwardly from said outer boundary of the play apparatus and connecting with each of said additional upper netting supports.

15. The apparatus of claim 11 further comprising a plurality of boundary nets, each net having at least one peripheral edge adapted for mounting to a grommet-bearing flange; and wherein said frame is comprised of a plurality of elongated frame members each having a flange extending along the longitudinal extent thereof, said flanges having a plurality of grommets; said frame members defining therebetween said outer boundary; and wherein each of said edges of said plurality of nets is mounted to at least one of said flanges.

16. The apparatus of claim 11 wherein at least one of said netting supports has an aperture therethrough, and further comprises securing means for securing said netting to said netting support, said securing means being elongated and having first and second longitudinal ends; said securing means being disposed in said aperture with said first and second ends extending from opposing sides of said aperture for securing engagement with said netting.

17. The apparatus of claim 11 wherein the plurality of spaced apart netting supports includes at least one laterally spaced apart upper support and at least two laterally spaced apart lower supports, lower than the upper support, the upper support located horizontally between the lower supports, the netting extending from one of the lower supports, over the upper support and to the other of the lower supports thereby defining the climbing and crawling pathway over said supports.

18. The apparatus of claim 11 wherein the plurality of netting supports includes a third laterally spaced lower netting support and further comprising generally vertical netting extending downwardly from the third netting support and defining with the third lower support and the two upper supports a lower climbing and crawling pathway over the third netting support and under the two upper supports and the other two lower supports.

19. The apparatus of claim 11 further comprising two additional upper netting supports located higher than the lower supports and further comprising netting extending downwardly from said outer boundary of the play apparatus and connecting with each of said additional upper netting supports.

20. The apparatus of claim 11 wherein the plurality of spaced apart netting supports includes at least first, second and third supports, said first and second supports being laterally spaced apart at a first height, said third support located horizontally between said first and second support, but at a height different from said first height, wherein the netting extends from said first support around said third support and to said second support, thereby defining a climbing and crawling pathway over said supports.

* * * * *